United States Patent [19]

Adamek

[11] Patent Number: 4,473,230

[45] Date of Patent: Sep. 25, 1984

[54] TENSION HANGER EMBODYING FIRE RESISTANT SEALING MEANS

[75] Inventor: Frank C. Adamek, Pasadena, Tex.

[73] Assignee: Gary Tool Company, Houston, Tex.

[21] Appl. No.: 578,905

[22] Filed: Feb. 10, 1984

[51] Int. Cl.[3] ..... F16J 15/08; E21B 33/12

[52] U.S. Cl. ..... 277/26; 277/30; 277/236; 285/140; 285/DIG. 18; 166/82

[58] Field of Search ..... 277/12, 22, 26, 30–33, 277/236; 285/140, 142, 143, DIG. 18; 166/82, 84, 86, 88

[56] References Cited

U.S. PATENT DOCUMENTS

| | | | |
|---|---|---|---|
| 2,272,022 | 2/1942 | Roberts | 277/30 X |
| 4,350,346 | 9/1982 | Fowler | 277/26 |
| 4,390,063 | 6/1983 | Wells | 277/30 X |
| 4,390,186 | 6/1983 | McGee et al. | 277/236 |

*Primary Examiner*—Robert S. Ward

*Attorney, Agent, or Firm*—Arthur E. Fournier

[57] ABSTRACT

A tubular member (42, 62) of the type commonly utilized in wellhead equipment (10) having embodied therein sealing means (72, 64) operative when cooperatively associated with a mating member (16, 14) to effectuate the establishment of a fire resistant seal between the tubular member (42, 62) and the mating member (16, 14). The subject tubular member (42, 62) preferably terminates at one end thereof in an extended neck portion (82, 80) with the sealing means (72, 64) being provided on the outside circumferential surface of the extended neck portion (82, 80) adjacent the free end of the latter. The mating member (16, 14) includes an inside circumferential surface suitably dimensioned such that the tubular member (42, 62), when inserted therewithin, can be made to occupy a fixed longitudinal position relative thereto. The sealing means (72, 64) includes an annular band (74, 66) embodying preselected height and width dimensions, the ratio of which falls within a predetermined range such that when the tubular member (42, 62) and the mating member (16, 14) occupy the aforesaid fixed longitudinal position thereof the engagement of the annular band (74, 66) of the tubular member (42, 62) with the inner circumferential surface of the mating member (16, 14) establishes an elastic but fire resistant seal therebetween characterized by the fact that plastic deformation is avoided yet the required unit loading is furnished thereby.

16 Claims, 4 Drawing Figures

TENSION HANGER EMBODYING FIRE RESISTANT SEALING MEANS

CROSS REFERENCE TO RELATED APPLICATIONS

This application is hereby cross referenced to the following five patent applications which have been previously filed and which are assigned to the same assignee as the present application: U.S. Patent Application Ser. No. 469,356 filed Feb. 24, 1983 entitled "Fire Resistant Connections And U-Like Sealing Means Therefor", filed in the name of Frank C. Adamek; U.S. Patent Application Ser. No. 469,357 filed Feb. 24, 1983 entitled "Fire Resistant Connections And Dovetail-Like Sealing Means Therefor", filed in the name of Robert E. Bush; U.S. Patent Application Ser. No. 469,358 filed Feb. 24, 1983 entitled "Fire Resistant Connections And T-Like Sealing Means Therefor", filed in the name of Frank C. Adamek; U.S. Patent Application Ser. No. 469,354 filed Feb. 24, 1983 entitled "Fire Resistant Connections And Double Ribbed Sealing Means Therefor", filed in the name of Robert E. Bush; and U.S. Patent Application Ser. No. 469,355 filed Feb. 24, 1983 entitled "Fire Resistant Connections Embodying Heat Transfer Means", filed in the names of Charles D. Bridges, et al.

BACKGROUND OF THE INVENTION

This invention relates to means for effecting a seal between surfaces, and more particularly to means for establishing a fire resistant metal-to-metal seal between the outer surface of a tubular member, such as a tension hanger, and the inner surface of a mating member of the type that are known to exist in wellhead equipment.

The fact that extreme service conditions are encountered in wellhead applications has long been recognized. Moreover, it has long been known that the nature of such extreme service conditions encompasses, by way of example and not limitation, conditions such as the presence of high and low temperature, sour gas, high fluid velocity, pressure cycling, thermal shock, and/or the existence of forces of vibration, bending, compression, tension or any combination of these forces. In an effort to provide equipment that would be suitable for employment in such wellhead applications, i.e., that would successfully withstand being subjected to extreme service conditions of this type, metal-to-metal seals have heretofore been employed for purposes of effectuating seals in equipment designed to be used in wellhead applications of the aforedescribed type. This selection of metal-to-metal seals for use in this manner has been influenced to some extent by environmental and economic considerations. Moreover, the metal-to-metal seals that have actually been selected for use for this purpose have been of various designs. By way of illustration, reference may be had among others, to U.S. Pat. No. 4,390,186, which issued on June 28, 1983 to John K. McGee et al., for a showing of a metal-to-metal seal that is disclosed to be suitable for use in equipment, which is designed for employment in wellhead applications.

Although these earlier types of metal-to-metal seals when employed in equipment designed for use in wellhead applications, have proven generally to be capable of withstanding the extreme service conditions associated with such applications, i.e., conditions of a sort that have been enumerated hereinbefore, these metal-to-metal seals were never intended to be fire resistant. That is, no requirement existed insofar as the design of these metal-to-metal seals was concerned that they embody the capability of maintaining sealability during periods of thermal expansion and contraction occasioned by the occurrence of wellhead fires. It is only more recently that the matter of fire resistance has come to be viewed as a consideration in the design of seals of the type found in equipment that is intended for use in wellhead applications. Moreover, to some in the industry this matter of fire resistance has gone beyond the state of being simply a consideration, but rather has now risen to the level of being a requirement that future designs of metal-to-metal seals must satisfy.

The high temperatures which are encountered during wellhead fires give rise to a variety of problems. Included among these are problems that can be linked to the rapid thermal heatup and cooldown of the material which is exposed to the wellhead fire, the expansion and/or contraction of the exposed material, and/or a loss in the properties which the exposed material exhibits. For ease of classification, however, the aforereferenced problems fall basically into two categories. Namely, there are those problems which relate to the structural characteristics exhibited by the wellhead equipment material upon being exposed to a wellhead fire, and there are those problems which relate to the capability of seals in wellhead equipment to maintain their sealability when the wellhead equipment is subjected to a wellhead fire.

Regarding first the matter of the structural characteristics of wellhead equipment material, insofar as rendering such material fire resistant is concerned the loss of tensile strength exhibited thereby when exposed to a wellhead fire can be compensated for in several ways. For example, the pressure limits which the equipment must be capable of withstanding is commonly permitted to be downrated by up to twenty-five percent. In addition, the pressure vessel walls of the equipment in question generally are permitted to be constructed such that they are oversized. Accordingly, it has been found that this twenty-five percent downrating of the pressure limits which the equipment must be capable of withstanding coupled with the oversizing of the pressure vessel walls of the equipment is sufficient to compensate for the loss of the tensile strength that occurs when the wellhead equipment is exposed to elevated temperatures such as those to which this equipment is exposed during the occurence of a wellhead fire.

Although wellhead housings become large when the walls thereof are oversized, such housings nevertheless remain within practical limits. Therefore, there is no necessity to make use of exotic steels, etc., for this type of equipment. This is not to say, though, that future developments in the area of material research may not produce new cost effective, high strength alloys, which would enable a reduction to be had in the sizing of wellheads of the type to which reference has been had hereinbefore.

Turning now to the matter of the sealability of the seals that are embodied in wellhead equipment, it is essential for the reasons that have been discussed previously herein that such seals be effectuated through the use of metal-to-metal seals. On the other hand, however, if such metal-to-metal seals are to be capable of exhibiting adequate tensile strength at elevated temperatures the view has been taken that there must be utilized therein high strength materials as overlays or seal ring materials. Elastomers, as they are known today, are known to perform unsatisfactorily when employed under the sort of conditions to which wellhead equipment is subjected when a wellhead fire occurs. The one nonmetallic material which may have some merit for use in such applications is that which is referred to by those in this industry as "Grafoil".

By and large, therefore, it can thus be seen that in order to develop wellhead equipment that is fire resistant, a need has existed to develop improved sealing techniques that would be suitable for use to effect seals that would maintain their sealability at elevated temperatures. More specifically, there has existed a need to develop improved high temperature sealing techniques that would be applicable for use in connection with both the tubular and annular seals that are to be found in wellhead equipment, and which would enable the latter equipment to withstand in terms of sealability the range of temperatures to which such equipment would commonly be exposed in the course of a wellhead fire. In this context, in order to develop such an improved high temperature sealing technique there would exist a need to address the following areas: the thermal and metallurgical characteristics of the materials involved, the relative movement that occurs during the mating parts, and the sliding action that the seal must endure.

Efforts have been undertaken looking to the development of such high temperature sealing techniques. Moreover, the focus of these efforts, at least at the outset, has been directed towards successfully providing a sealing means wherein the seal effected therewith would be capable of withstanding the high temperature required in order to enable the sealing means to be classified as being fire resistant. To this end, considerable time and effort was devoted to the development of a suitable clamp connection that would maintain its sealability at elevated temperatures. However, not only did the mass of such a clamp connection prove to be detrimental to heat exchange properties of the wellhead equipment per se, but indeed proved to be uncontrollable in terms of torsional deflection and permanent set. In turn, the latter prevented retention of any seal that was dependent upon the clamp connection as a holding device.

As the result of the realization of the above, the development of a studded clamp connection was undertaken. However, the unfavorable heat transfer properties of the added mass of the clamp soon led to the abandonment of the clamp itself. This was done principally so that a more favorable heat transfer condition could be realized in a less irregular surface surrounding the wellhead housing. It was then concluded that the context of attempting to render wellhead equipment fire resistant clamp connections should not be utilized. Consequently, efforts were directed towards providing a new and improved form of connection. These efforts led to the development of the connections which comprise the subject matter of the five co-pending patent applications to which reference has been had hereinbefore, and which can be found listed herein under the heading "Cross Reference To Related Applications".

Apart from the need to provide fire resistant connections, a need has also been evidenced for accomplishing in a wellhead assembly a fire resistant seal as between, for instance, a tubular member such as a tension hanger and a mating member with which the tubular member is intended to be cooperatively associated. Insofar as, for example, tension hangers are concerned any seal utilized therewith must be capable of maintaining its sealability while yet undergoing movement of both an axial and a radial nature. More specifically, in accord with the mode of operation of a tension hanger, the latter is designed to be inserted into the bore of a mating member, such as a tubing bonnet. Moreover, in the course of being so inserted into the tubing bonnet, the seal with which the tension hanger is suitably provided is energized by virtue of its being moved into a tapered area suitably formed for this purpose in the mating member. That is, the effect of moving the seal into the aforesaid tapered area is to accomplish a preloading of the seal. After being preloaded in the aforesaid manner, movement is had of the seal into the straight bore of the mating member. The sidewalls defining the straight bore function to retain the seal preloaded for purposes of achieving both proper bearing stress and sealability. However, the exact location of the seal from an axial standpoint relative to the straight bore varies as a function of the extent to which the tension hanger must be moved in an axial direction in order to achieve the requisite tensioning thereof.

From the preceeding discussion, it can thus be seen in effecting a seal between a tension hanger and a mating member, the seal is first subjected to radial movement in order to accomplish the preloading thereof. Thereafter, the seal is subjected to axial movement while the tension hanger is undergoing tensioning. Having met these requirements, a seal in order to be considered fire resistant must also embody the capability of being able to maintain its sealability while being subjected to the elevated temperatures which are known to prevail during the occurrence of a wellhead fire. The effect, insofar as sealability is concerned, of these elevated temperatures on the tension hanger and the mating member that is cooperatively associated therewith is to cause an expansion and/or contraction of the exposed material of these members. In this regard, movement, i.e., expansion and contraction, in an axial direction is of primary concern. Movement in a radial direction generally poses no significant problem inasmuch as the coefficient of expansion of the two members, i.e., the tension hanger and the mating member, can be preselected such that they are very similar whereby any differential radial movement between the tension hanger and the mating member is insufficient to overcome the springing action of the radially compressed seal member, i.e., the preloading to which the seal has been subjected as described previously herein. On the other hand, during the course of moving axially within the straight bore of the mating member, the seal must maintain its sealability as the tension hanger and mating member expand and/or contract in response to their being subjected to elevated temperatures occasioned by the occurrence of a wellhead fire.

Thus, to summarize, it has been concluded from analytical and test results that materials do exist which are suitable for use in forming pressure containing members of wellhead housings, valve bodies, and bonnets. Further, it is viewed as being practical to construct valve bodies and wellhead housings of such materials. That is, the use of such materials for this purpose does not lead to enormous enlargement of the equipment to the point of being impractical. On the other hand, however, such materials are disadvantageously characterized insofar as concerns their suitability for use in performing a sealing function. Accordingly, it is essential that a new and improved form of seal be developed for use within wellhead equipment housings. Furthermore, such a new and improved form of seal must be of sufficient size and integrity to withstand the loading forces necessary to effect the sealing function. In addition, the materials from which such seals are fabricated must of necessity be selected for compatibility for their elevated temperature strength, and their thermal conductivity. Namely, it is very important that the material selected for use for fabricating such seals be such that the mating sealing surfaces that are produced as a consequence of the use thereof are compatible from the standpoint of thermal expansion and contraction, corrosivity, weldability and gall resistance. However, even when the above criteria has been satisfied, therre still remains a need to provide a high temperature seal, which in terms of its design as contrasted to the matter of the materials from which it is formed, is suitable for use in wellhead equipment that may be subjected to elevated temperatures of the type that are experienced during the course of a wellhead fire. That is, a need has been evidenced for a seal design wherein a seal constructed in accordance therewith would when employed in wellhead equipment be characterized by the fact that it possesses the capability of maintaining its sealability, even when the wellhead equipment in which it is embodied is involved in a wellhead fire.

It is, therefore, an object of the present invention to provide a new and improved form of metal-to-metal seal suitable for employment in wellhead equipment.

It is another object of the present invention to provide such a metal-to-metal seal, which when employed in wellhead equipment is capable of withstanding the conditions imposed thereupon during the occurrence of a wellhead fire.

It is still another object of the present invention to provide such a fire resistant metal-to-metal seal, which is characterized in that it exhibits adequate tensile strength even at the elevated temperatures that exist when a wellhead fire occurs.

A further object of the present invention is to provide such a fire resistant metal-to-metal seal, which is characterized in that it exhibits a capability of being able to maintain its sealability even at the elevated temperatures that exist when a wellhead fire occurs.

A still further object of the present invention is to provide such a fire resistant metal-to-metal seal, which is particularly suited for embodiment in a tubular member of the sort that is intended for employment in a wellhead assembly.

Yet an object of the present invention is to provide such a tubular member embodying such a fire resistant metal-to-metal seal wherein the seal is intended to be made to undergo radial movement in order to accomplish the preloading thereof.

Yet another object of the present invention is to provide such a tubular member embodying such a fire resistant metal-to-metal seal wherein after being preloaded the seal is intended to be capable of undergoing axial movement while yet retaining the bearing stress and the sealability required thereof.

Yet still another object of the present invention is to provide such a tubular member embodying such a fire resistant metal-to-metal seal which is relatively inexpensive to provide and easy to employ, while yet being capable of providing reliable and effective service even when exposed to the conditions that exist when a wellhead fire occurs.

SUMMARY OF THE INVENTION

In accordance with the present invention, there is provided a new and improved tubular member, which is suitable for use in wellhead equipment and which embodies a fire resistant metal-to-metal sealing means. When the subject tubular member is cooperatively associated with a mating member the sealing means of the former is operative to effectuate the establishment of a fire resistant seal between the tubular member and the mating member. At one end thereof the subject tubular member has an extended neck portion formed integral therewith. The sealing means is provided on the outside circumferential surface of the extended neck portion adjacent the free end thereof. The sealing means comprises an annular band formed integral therewith and of the same material as the extended neck portion of the subject tubular member. The height and width dimensions of the annular band are preselected such that the ratio thereof falls within a predetermined range. The preselection of the height and width dimensions of the annular band is predicated upon a consideration of both the bearing stress and the sealability that the seal formed by the engagement of the aforementioned annular band with the inner circumferential surface of the mating member must provide. With the subject tubular member occupying a fixed longitudinal position relative to the mating member, the seal formed by the engagement of the annular band of the tubular member with the inner circumferential surface of the mating member establishes an elastic but fire resistant seal between the tubular member and the mating member characterized in that plastic deformation of the seal is avoided yet the unit loading required thereof is furnished thereby.

DESCRIPTION OF A PREFERRED EMBODIMENT

Figure 1A:
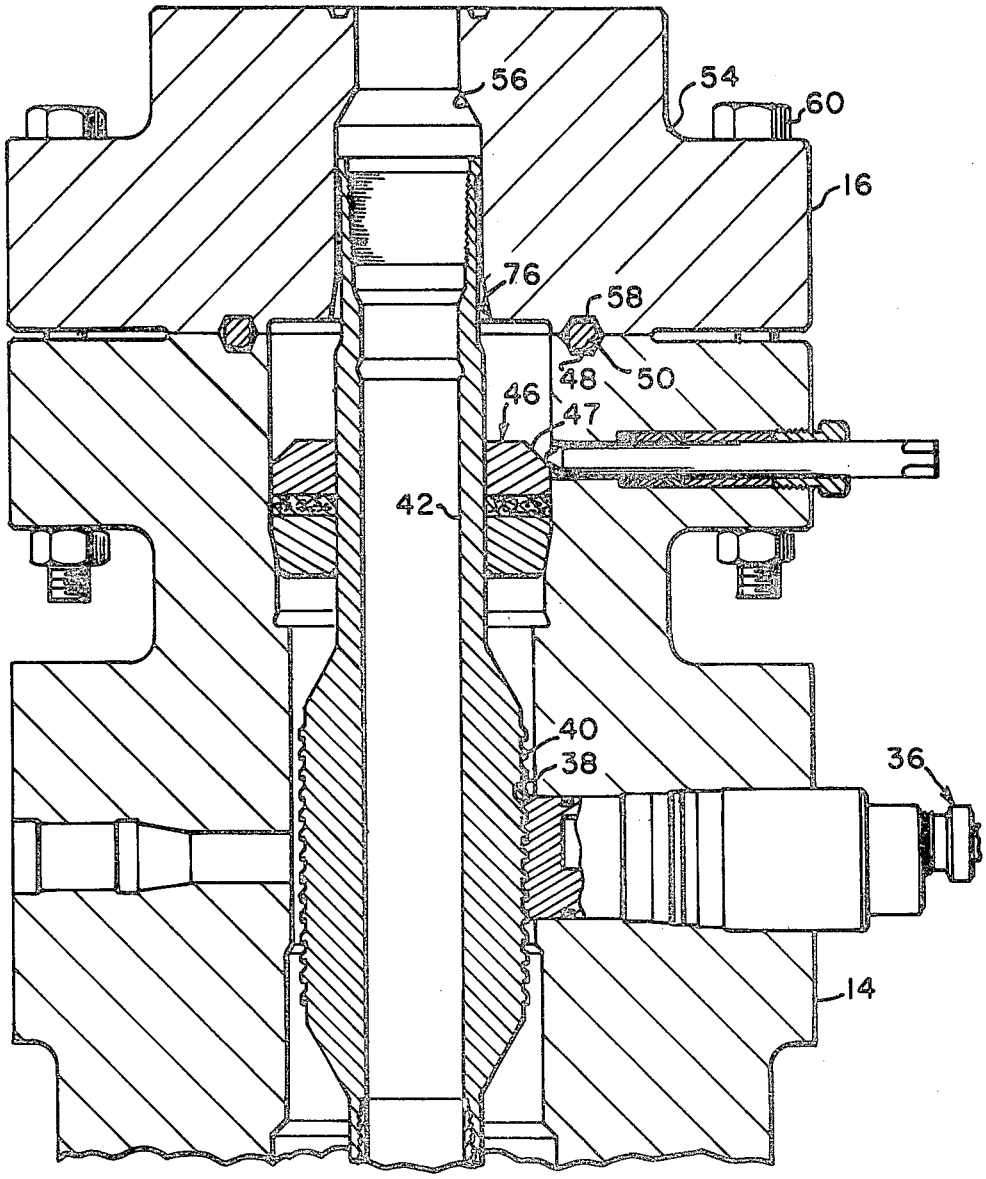
FIGS. 1*a* and 1*b*, when taken together, comprise a longitudinal sectional view of a wellhead illustrating two instances of use of a fire resistant metal-to-metal seal constructed in accordance with the present invention.
Figure 1B:
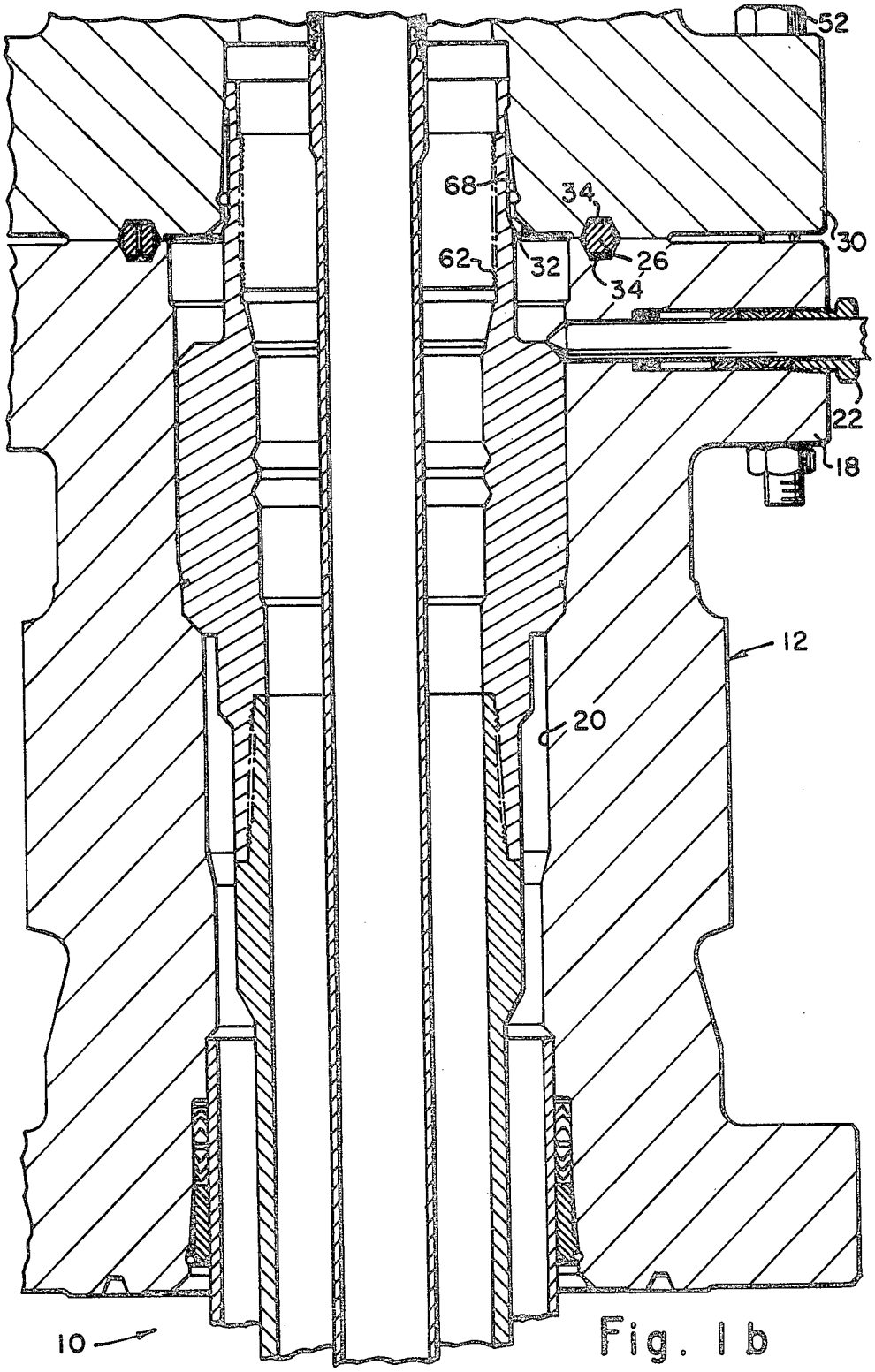

Referring now to the drawing, and more particularly to FIGS. 1*a* and 1*b* thereof, there is depicted therein a relevant portion of a wellhead, generally designated by reference numeral 10. In accordance with the illustration of FIGS. 1*a* and 1*b*, there are two instances of use in the wellhead 10 of a fire resistant metal-to-metal seal construced in conformity with the present invention. Inasmuch as the nature of the construction and the mode of operaton of wellheads per se are well-known to those skilled in the art, it is not deemed necessary, therefore, to set forth herein a detailed description of the wellhead 10 shown in FIGS. 1*a* and 1*b*. Rather, it is deemed sufficient for purposes of obtaining an understanding of a wellhead 10, wherein use may be made therein of one or more fire resistant metal-to-metal seals constructed in accordance with the present invention, that there be presented herein merely a generalized description of the nature of the construction and the mode of operation of the components of the wellhead 10. For a more detailed description of the nature of the construction and/or the mode of operation of the components of the wellhead 10, which are not described herein in depth, reference may be had to the teachings of wellheads to be found in the prior art. Thus, to summarize FIGS. 1*a* and 1*b*, when taken together, are intended to depict a typical setting of a wellhead in which use can be made of the fire resistant metal-to-metal seal of the present invention.

With further reference to FIGS. 1*a* and 1*b* of the drawing, the wellhead 10 as depicted therein includes a casing spool 12, a tubing head 14 and a tubing bonnet 16. Moreover, as regards the casing spool 12, the latter has an upper end flange seen at 18 in FIG. 1*b*, and a longitudinal bore of suitable dimensions, which is to be found designated in the drawing by the reference numeral 20. For a purpose to which reference will again be had hereinafter, the casing spool 12 in a manner well-known to those skilled in this art embodies in the upper end flange 18 thereof a hold-down means, denoted generally by the reference numeral 22. Inasmuch as the hold-down means 22 is of conventional construction and is only incidentally related to the subject matter of the present invention, it is not deemed necessary to describe herein in any more detail the nature of the construction thereof. Rather, it is deemed sufficient to merely take note of the fact that as the name applied thereto implies, the function of the hold-down means 22 is to effect a hold-down of another member with which the casing spool 12 is intended to be cooperatively associated. To complete for purposes of the instant application a description of the casing spool 12, there is provided in the surface of the upper end flange 18 thereof a circumferentially extending tapered groove 24 of conventional construction in which in accord with conventional practice the ring gasket, seen at 26 in FIG. 1*b*, is designed to be received.

Proceeding now with a description of the tubing head 14, the latter is provided as viewed with reference to FIGS. 1*a* and 1*b* of the drawing, with both an upper and a lower end flange, the latter flanges being designated in the drawing by means of the reference numerals 28 and 30, respectively. In addition, at the center thereof the tubing head 14 embodies a suitably dimensioned longitudinal bore denoted by the reference numeral 32. The surface of the lower end flange 30 has formed therein a circumferentially extending tapered groove 34 of conventional construction. The tapered groove 34 is both suitably located and suitably dimensioned in the lower end flange 30 of the tubing head 14 so as to be alignable with and in terms of configuration complementary to the previously described tapered groove 24 with which the upper end flange 18 of the casing spool 12 is suitably provided such that when the tubing head 14 is assembled to the casing spool 12 in the manner depicted in the drawing the ring gasket 26 is held captured in the opening that is created by the tapered grooves 24 and 34 formed in the end flanges 18 and 30, respectively.

Continuing with the description of the tubing head 14, intermediate the upper and lower end flanges 28 and 30, respectively, thereof, the tubing head 14 in a conventional manner is suitably provided with means, denoted generally in the drawing by the reference numeral 36. The means 36 is operative for purposes of effecting an interengagement between the tubing head 14 and another member 42 with which the tubing head 14 is designed to be cooperatively associated. More specifically, in a manner which is well-known to those skilled in this art, the interconnection of the means 36 with the aforesaid another member 42 is accomplished through the engagement of teeth-like elements, seen at 38 and 40 in the drawing, with which the means 36 and the aforesaid another member 42, respectively, are each suitably provided. Thus, it is to be understood that the means 36 functions to detachably lock the tubing head 14 and the aforesaid another member 42 one to another. Inasmuch as the nature of the construction of the means 36 as well as the mode of operation thereof are well-known to those skilled in this art coupled with the fact that the means 36 is only incidentally related to the subject matter of the present invention, any further discussion herein of the means 36 is deemed to be unnecessary to an understanding of the present invention.

Completely for purposes of the instant application the description of the tubing head 14, the upper end flange 28 thereof like the upper end flange 18 of the casing spool 12 is suitably provided with hold-down means, denoted generally in the drawing by the reference numeral 44. Since the hold-down means 44 is identical both in terms of construction and in terms of mode of operation to the hold-down means 22, which has been described herein previously, it is not deemed necessary to reiterate this discussion for purposes of setting forth herein a description of the hold-down means 44. Suffice it to say that the hold-down means 44 is designed to be operative to effect a hold-down of the annular packoff assembly, which is shown in FIG. 1*a* of the drawing and which has been identified therein generally by the reference numeral 46. To this end, in order to accomplish the aforereferenced hold-down action the annular packoff assembly 46 is suitably provided at 47 with a shoulder that the hold-down means 44 is designed to engage. Like the lower end flange 30 of the tubing head 14, the surface of the upper end flange 28 of the tubing head 14 also has suitably formed therein a circumferentially extending tapered groove 48 of conventional construction. The ring gasket 50 in accord with conventional practice is designed to be received in the tapered groove 48. For purposes of securing the tubing head 14 to the casing spool 12, there is preferably utilized fastening means in the form of conventional threaded fasteners, the latter being seen at 52 in the drawing.

Turning now to a consideration of the tubing bonnet 16, the latter, as viewed with reference to FIG. 1*a* of the drawing, is provided with a lower end flange that has been identified therein through the use of the reference numeral 54, and a suitably dimensioned longitudinal bore denoted by the reference numeral 56. The surface of the lower end flange 54 of the tubing bonnet 16, in the same manner as the upper and lower end flanges 28 and 30, respectively, of the tubing head 14 and the upper end flange 18 of the casing spool 12 has formed therein a circumferentially extending tapered groove 58 of conventional construction. In terms of location and configuration the tapered groove 58 is alignable with and complementary to the tapered groove 48 with which the upper end flange 28 of the tubing head 14 is provided such that when the tubing bonnet 16 and the tubing head 14 bear the relationship one to another that is depicted in FIG. 1*a* of the drawing, the ring gasket 50 is held captive in the opening created by the tapered grooves 48 and 58. For purposes of securing together the tubing head 14 and the tubing bonnet 16, fastening means in the form of threaded fasteners, the latter being seen at 60 in FIG. 1*a*, are preferably employed.

In order to set forth a description hereinafter of the fire resistant metal-to-metal sealing means to which the present invention is directed, reference will be had particularly to FIGS. 2 and 3 of the drawing. Focusing attention first on FIG. 3 of the drawing, there is depicted therein one instance wherein the fire resistant metal-to-metal sealing means of the present invention has been utilized in the wellhead 10 for purposes of accomplishing a fire resistant metal-to-metal seal and in particular in this instance between the tubing head 14 and another member, the latter being denoted generally in FIG. 3 by means of the reference numeral 62. For ease of reference, the reference numeral 64 will be employed for purposes of denoting generally, in connection with the discussion of the structure in FIG. 3 that follows, the fire resistant metal-to-metal sealing means that is depicted therein. Also, for purposes of this discussion of FIG. 3, the member 62, which can be seen to embody a tubular configuration, shall be deemed to be a casing hanger.

Continuing with a description of the fire resistant metal-to-metal sealing means 64, the latter includes the seal 66 with which in a manner yet to be described the casing hanger 62 is provided and the inner surface of the longitudinal bore 32 of the tubing head 14 which the seal 66 is designed to engage. As will be best understood with reference to FIG. 3 of the drawing the seal 66 consists of an annular band, which is formed integral with the casing hanger 62 on the outer surface thereof and so as to extend around the circumference of the casing hanger 62 in juxtaposed relation to the free end, i.e., the upper end as viewed with reference to FIG. 3, thereof. The annular band 66 embodies dimensions that are preselected. More specifically, the height of the annular band 66, which for purposes of this discussion is defined to be the distance to which the annular band 66 projects in an outward direction from the outer surface of the casing hanger 62 and the width of the annular band 66, which for purposes of this discussion is defined to be the distance to which the annular band 66 extends longitudinally along the outer surface of the casing hanger 62 from the free end thereof, are predetermined. That is, the height and width dimensions which the annular band 66 embodies are preselected. Moreover, for purposes of establishing the height and the width of the annular band 66 the following two factors are given primary consideration; namely, the bearing stress and the sealability that must exist between the annular band 66 and the inner surface of the longitudinal bore 32 in order for there to be established a fire resistant metal-to-metal seal between the casing hanger 62 and the tubing head 14. Preferably, the height and width dimensions of the annular band 66 are expressed in ratio form.

For purposes of understanding the relationship that the height and width dimensions of the annular band 66 have to the factors of bearing stress and sealability, there needs to be described herein the manner in which the engagement of the annular band 66 with the inner surface of the longitudinal bore 32 is accomplished. To this end, referring particularly to FIG. 3 of the drawing, it is to be noted that the longitudinal bore 32 includes a first portion, denoted by the reference numeral 68, which is in the form of a taper, and a second portion, designated by the reference numeral 70, which is substantially planar, i.e., extends substantially parallel to the longitudinal axis of the wellhead 10. That is to say, the inner surface of the longitudinal bore 32 includes a preload taper portion 68 and a straight bore portion 70.

Figure 3:
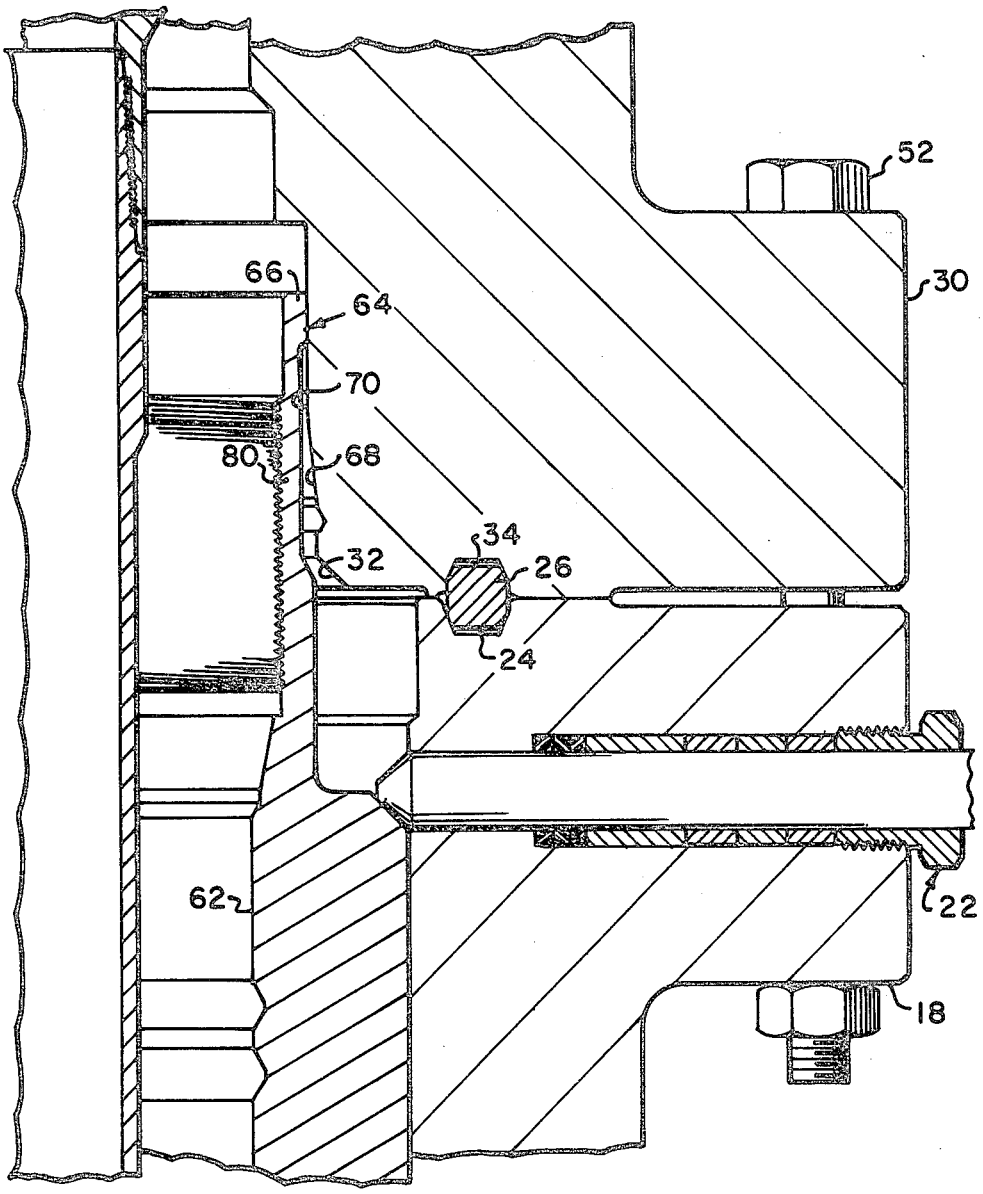
FIG. 3 is a longitudinal sectional view of a portion of the wellhead of FIGS. 1*a* and 1*b* illustrating a second instance of use of a fire resistant metal-to-metal seal constructed in accordance with the present invention.

In order to accomplish the engagement of the annular band 66 of the casing hanger 62 with the longitudinal bore 32 of the tubing head 14 in the manner that is to be found illustrated in FIG. 3 of the drawing, the annular band 66 must be capable of maintaining its engagement with the inner surface of the longitudinal bore 32 while yet undergoing movement of both an axial and a radial nature. More specifically, in accord with the manner in which a casing hanger, such as the hanger 62, is designed to be inserted into the bore of a mating member, such as the longitudinal bore 32 of the tubing head 14, the annular band 66 in the course of the casing hanger 62 being so inserted into the tubing head 14 is made to engage the preload taper portion 68 of the longitudinal bore 32. That is, the effect of moving the annular band 66 through the preload taper portion 68, which is suitably formed for this purpose in the longitudinal bore 32 of the tubing head 14, is to accomplish a preloading of the annular band 66. Namely, as the annular band 66 is made to move axially through the preload taper portion 68, the free end of the casing hanger 62 and concomitantly therewith the annular band 66 undergoes movement of a radial nature. It is because of this radial movement to which the annular band 66 is subjected that the latter becomes preloaded. Thus, to the extent that the annular band 66 projects outwardly of the outer surface of the casing hanger 62, i.e., the greater the height dimension of the annular band 66, the more the latter will be preloaded as it is made to traverse the preload taper portion 68. Further, the greater the extent to which the annular band 66 is preloaded, the greater will be the bearing stress that will be imparted between the annular band 66 and the inner surface of the longitudinal bore 32 when the casing hanger 62 and the tubing head 14 are positioned as illustrated in FIG. 3 of the drawing relative to each other.

After being preloaded in the aforesaid manner, the annular band 66 is caused to continue its movement in an axial direction, i.e., in an upward direction as viewed with reference to FIG. 3 of the drawing such that upon completing the traverse of the preload taper portion 68 of the longitudinal bore 32, the annular band 66 enters the straight bore portion 70 of the longitudinal bore 32. With the annular band 66 positioned in the straight bore portion 70 of the longitudinal bore 32, the sidewalls of the straight bore portion 70 function to retain the annular band 66 through their interengagement therewith in a preloaded condition. Hence, the bearing stress, which is required to exist between the casing hanger 62 and the tubing head 14, is maintained. Fronm an axial standpoint, the exact location whereat the annular band 66 engages the sidewalls of the straight bore portion 70 will vary as a function of the extent to which the casing hanger 62 must be moved in an axial direction relative to the tubing head 14 in order that the proper relationship will exist between the casing hanger 62 and the tubing head 14. Because the exact location whereat the annular band 66 will engage the sidewalls of the straight bore portion 70 of the longitudinal bore 32 is unknown at the outset, there is a need to ensure that the width dimension of the annular band 66 is of adequate size that sufficient sealing surface will be provided thereby when the annular band 66 is made to engage, in the manner depicted in FIG. 3 of the drawing, the sidewalls of the straight bore portion 70 of the longitudinal bore 32. Based on a consideration of the preceding discussion, it should not, therefore, be apparent that a correlation exists between the height dimension of the annular band 66 and the bearing stress that exists between the casing hanger 62 and the tubing head 14 and between the width dimension of the annular band 66 and the sealing capability of the annular band 66 relative to the sidewalls of the straight bore portion 70 of the longitudinal bore 32. For this reason, the height and width dimensions of the annular band 66, which constitutes one of the elements of the fire resistant metal-to-metal sealing means 64, are preselected such as to ensure that the fire resistant metal-to-metal sealing means 64 embodies to the requisite degree the bearing stress and sealability characteristics that must exist in order to ensure that the metal-to-metal seal, which is established through the engagement of the annular band 66, i.e., the casing hanger 62, with the sidewalls of the straight bore portion 70 of the longitudinal bore 32, i.e., the tubing head 14, is fire resistant.

By way of a summation of the preceding discussion regarding the fire resistant metal-to-metal sealing means 64 of the present invention, constructed in accordance with the illustration thereof in FIG. 3 of the drawing, it can thus be seen that in effecting a seal between the casing hanger 62 and the tubing head 14, the annular band 66 is first subjected to radial movement in order to accomplish the preloading thereof. Thereafter, the annular band 66 is subjected to axial movement while the casing hanger 62 is undergoing axial movement in the course of establishing the proper positioning thereof relative to the tubing head 14. Having satisfied these requirements as regards movement of a radial and an axial nature, the seal that is effected by virtue of the engagement of the annular band 66 with the sidewalls of the straight bore position 70 of the longitudinal bore 32 in order to be considered fire resistant must also embody the capability of being able to maintain its sealability while being subjected to the elevated temperatures, which are known to prevail during the occurrence of a wellhead fire. The effect, insofar as sealability is concerned, of these elevated temperatures on the tubing head 14 and the casing hanger 62 that is cooperatively associated therewith is to cause an expansion or contraction of the exposed material of these members. In this regard, movement, i.e., expansion and contraction, in an axial direction is of primary concern. Movement in a radial direction generally poses no significant problem inasmuch as the coefficient of expansion of the two members, i.e., the casing hanger 62 and the tubing head 14, can be preselected such that they are very similar whereby any differential radial movement between the casing hanger 62 and the tubing head 14 is insufficient to overcome the springing action of the radially compressed seal member, i.e., the preloading to which the annular band 66 has been subjected as described previously herein. On the other hand, during the course of moving axially within the straight bore portion 70 of the longitudinal bore 32 of the tubing head 14, the annular band 66 must maintain its sealability with the sidewalls of the straight bore portion 70 as the casing hanger 62 and tubing head 14 expand and/or contract in response to their being subjected to elevated temperatures occasioned by the occurrence of a wellhead fire. In accord with the teachings of the present invention, it has been determined that through the proper selection of dimensions for the height and width of the annular band 66 it is possible to establish a fire resistant metal-to-metal seal between the casing hanger 62 and the tubing head 14 utilizing the fire resistant metal-to-metal sealing means 64 constructed in accordance with the illustration thereof in FIG. 3 of the drawing.

Figure 2:
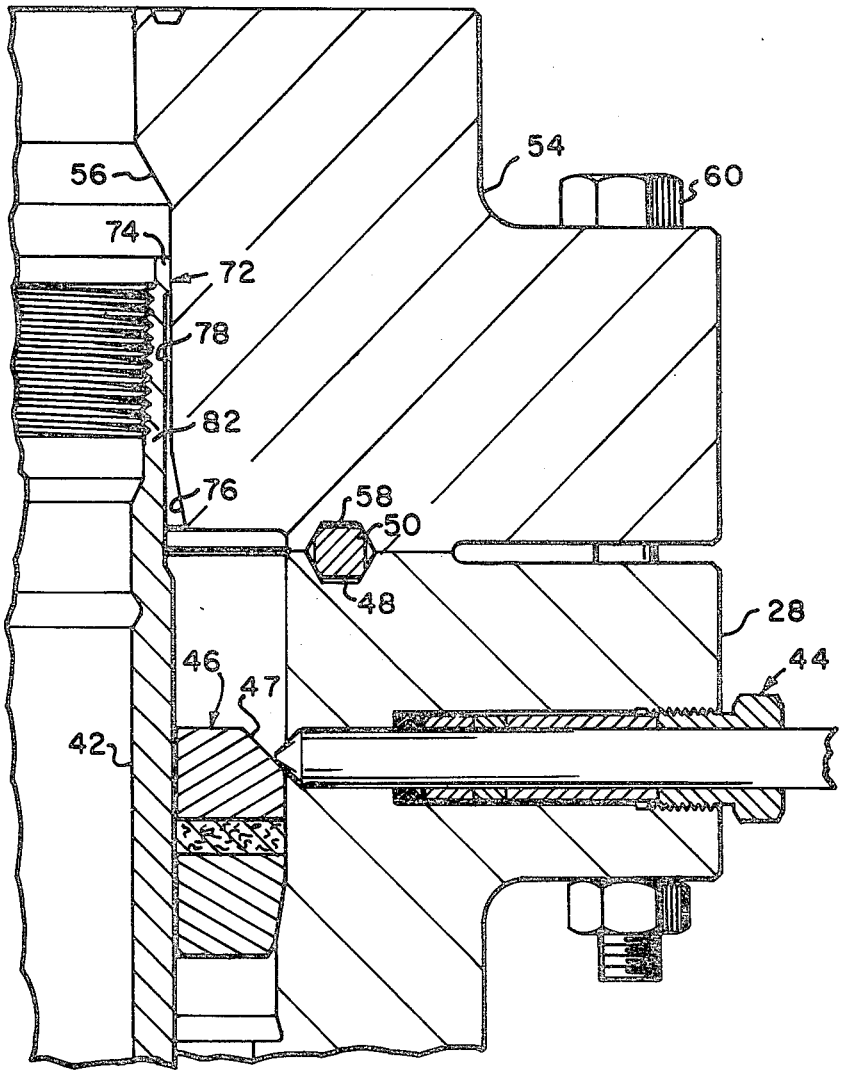
FIG. 2 is a longitudinal sectional view of a portion of the wellhead of FIGS. 1*a* and 1*b* illustrating a first instance of use of a fire resistant metal-to-metal seal constructed in accordance with the present invention.

Referring next to FIG. 2 of the drawing, there is depicted therein another instance wherein the fire resistant metal-to-metal sealing means of the present invention has been utilized in the wellhead 10 for purposes of accomplishing a fire resistant metal-to-metal seal, and in particular in this instance between the tubing bonnet 16 and another member, the latter having previously been denoted hereinbefore by the reference numeral 42. For ease of reference, the reference numeral 72 will be employed for purposes of denoting generally, in connection with the discussion of the structure in FIG. 2 that follows, the fire resistant metal-to-metal sealing means that is depicted therein. Also, for purposes of this discussion of FIG. 2 the member 42, which can be seen to embody a tubular configuration, shall be deemed to be a tension hanger.

Continuing with a description of the fire resistant metal-to-metal sealing means 72, the latter includes the seal 74 with which in a manner yet to be described the tension hanger 42 is provided and the inner surface of the longitudinal bore 56 of the tubing bonnet 16 which the seal 74 is designed to engage. As will be best understood with reference to FIG. 2 of the drawing, the seal 74 consists of an annular band, which is formed integral with the tension hanger 42 on the outer surface thereof and so as to extend around the circumference of tension hanger 42 in juxtaposed relation to the free end, i.e., the upper end, as viewed with reference to FIG. 2 thereof. The annular band 74 embodies dimensions that are preselected. More specifically, the height and width of the annular band 74 for purposes of the following discussion are considered to be defined in the same fashion as the height and width of the annular band 66 have been defined previously herein in connection with the description of the fire resistant metal-to-metal sealing means 64 depicted in FIG. 3. Moreover, the discussion which has been had previously herein concerning the relationship which exists between the height and width of the annular band 66 and the factors of bearing stress and sealability is deemed to be equally applicable as regards the factors of bearing stress and sealability and the height and width dimensions of the annular band 74. As such, it is not deemed to be necessary to reiterate this discussion insofar as the annular band 74 of the tension hanger 42 is concerned. Rather, it is deemed sufficient to merely take note of the fact that the longitudinal bore 56 of the tubing bonnet 16 includes a preload taper portion 76 and a straight bore portion 78 and as depicted in FIG. 2 the annular band 74 of the tension hanger 42 is designed to engage straight bore portion 78 of the longitudinal bore 56 of the tubing bonnet 16.

The mode of operation of the fire resistant metal-to-metal sealing means 72 of FIG. 2 is essentially the same as that of the fire resistant metal-to-metal sealing means 64 of FIG. 3, which has been described herein previously. Namely, in accord with the mode of operation thereof, the tension hanger 42 is designed to be received in the bore 56 of the tubing bonnet 16. Moreover, in the course of being so inserted into the tubing bonnet 16, the annular band 74 with which the tension hanger 42 is suitably provided is energized as it traverses the preload taper portion 76, which is suitably formed for this purpose in longitudinal bore 56 of the tubing bonnet 16. That is, the effect of the annular band 74 being made to move through the preload taper portion 76 is to accomplish the preloading of the annular band 74. After being preloaded in the aforesaid manner, the annular band 74 is caused to move into the straight bore portion 78 of the longitudinal bore 76 of the tubing bonnet 16. The sidewalls defining the straight bore portion 78 function to retain the annular band 74 preloaded for purposes of achieving the proper bearing stress between the annular band 74, i.e., the tension hanger 42, and the sidewalls of the straight bore portion 78, i.e., the tubing bonnet 16. However, the exact location of the annular band 74 from an axial standpoint relative to the sidewalls of the straight bore portion 78 varies as a function of the extent to which tension hanger 42 must be moved in an axial direction in order to realize the requisite tensioning thereof. To thus summarize, as in the case of the fire resistant metal-to-metal sealing means 64 previously described herein, in accord with the teachings of the present invention it has been determined that through the proper selection of dimensions for the height and width of the annular band 74 it is possible to establish a fire resistant metal-to-metal seal between the tension hanger 42 and the tubing bonnet 16 utilizing the fire resistant metal-to-metal sealing means 72 constructed in accordance with the illustration thereof in FIG. 2 of the drawing.

For purposes of setting forth herein the best mode embodiment of the invention, it is to be noted that the casing hanger 62 as depicted in FIG. 3 of the drawing and the tension hanger 42 depicted in FIG. 2 of the drawing each embody an extended neck portion 80 and 82, respectively. Further, the annular band 66 in the case of the casing hanger 62 and the annular band 74 in the case of the tension hanger 42 are formed on the outer surface of and at the free end of the extended neck portions 80 and 82, respectively. By making use of the extended neck portions 80 and 82 in the case of the casing hanger 62 and the tension hanger 42, respectively, the implementation of the invention insofar as concerns the placement of the annular bands 66 and 74 on the casing hanger 62 and the tension hanger 42, respectively, as well as insofar as concerns ensuring the proper engagement of the annular band 66 with the sidewalls of the straight bore portion 70 and the annular band 74 with the sidewalls of the straight bore portion 78 is found to be facilitated. Also, it is to be understood that in accord with the best mode embodiment of the invention, with the annular bands 66 and 74 being positioned relative to the sidewalls of the straight bore portions 76 and 78, respectively, as depicted in FIGS. 3 and 2, respectively, the entire faces of the annular bands 66 and 74 preferably make engagement with the sidewalls of the straight bore portions 70 and 78, respectively. That is to say, when the annular bands 66 and 74 are in contact with the sidewalls of the straight bore portions 70 and 78, respectively, as depicted in FIGS. 3 and 2, respectively, the faces of the annular bands 66 and 74 lie in planes that extend parallel to the planes that are defined by the centerlines of the straight bore portions 70 and 78, respectively. To this end, a slight taper may need to be imparted to the faces of the annular bands 66 and 74 when the latter are not preloaded in order that after being preloaded the faces of the annular bands 66 and 74 will embody the desired parallel relationship which has been referred to above.

By way of further exemplification, in accord with the best mode embodiment of the invention, if it is determined that the width dimension of the annular band 66 and/or 74 needs to be approximately one-quarter inch, then commonly it is found that the height dimension of the annular band 66 and/or 74 is required to be somewhere between approximately one-sixteenth and one-eighth inch. Thus, it is can be seen that there exists a ratio of approximately two to one insofar as the width to height ratio of the annular band 66 and/or 74 is concerned.

Thus, in accordance with the present invention there has been provided a new and improved form of metal-to-metal seal suitable for employment in wellhead equipment. Moreover, the subject metal-to-metal seal of the present invention when employed in wellhead equipment is capable of withstanding the conditions imposed thereupon during the occurrence of a wellhead fire. In addition, in accord with the present invention a fire resistant metal-to-metal seal is provided, which is characterized in that it exhibits adequate tensile strength even at the elevated temperatures that exist when a wellhead fire occurs. Further, the fire resistant metal-to-metal seal of the present invention is characterized in that it exhibits the capability of being able to maintain its sealability even at the elevated temperatures that exist when a wellhead fire occurs. Additionally, in accord with the present invention a fire resistant metal-to-metal seal is provided, which is particularly suited for embodiment in a tubular member of the sort that is intended for employment in a wellhead assembly. Also, the tubular member embodying the fire resistant metal-to-metal seal of the present invention is characterized in that the seal is intended to be made to undergo radial movement in order to accomplish the preloading thereof. Penultimately, in accord with the present invention the tubular member embodying such a fire resistant metal-to-metal seal is characterized in that after being preloaded the seal is intended to be capable of undergoing axial movement while yet retaining the bearing stress and the sealability required thereof. Finally, the tubular member embodying the fire resistant metal-to-metal seal of the present invention is characterized in that it is relatively inexpensive to provide and easy to employ, while yet being capable of providing reliable and effective service even when exposed to the conditions that exist when a wellhead fire occurs.

While two embodiments of my invention have been shown, it will be appreciated that modifications thereof, some of which have been alluded to hereinabove, may still be readily made thereto by those skillled in the art. I, therefore, intend by the appended claims to cover the modifications alluded to herein as well as all other modifications, which fall within the true spirit and scope of my invention.

What is claimed is:

1. A fire resistant metal-to-metal sealing means for effectuating the establishment of a fire resistant seal between a pair of mating metallic members comprising:

a. a first metallic member having a longitudinal bore and an inner circumferential surface defined by said longitudinal bore, said inner circumferential surface including a first tapered portion and a second straight bore portion; and b. a second metallic member of tubular configuration having an outer circumferential surface, said second metallic member being at least partially inserted into said longitudinal bore of said first metallic member such as to be coaxially received therewithin with said inner circumferential surface of said first metallic member surrounding said outer circumferential surface of said second metallic member, said second metallic member including an annular band formed on said outer circumferential surface thereof adjacent one end of said second metallic member, said annular band engaging said inner circumferential surface of said first metallic member as said second metallic member is inserted into said longitudinal bore of said first metallic member such that as said annular band traverses said first tapered portion said annular band is caused to become preloaded and upon entering said second straight bore portion said annular band effects a seal therewith while remaining preloaded, said annular band having a height and a width embodying predetermined dimensions that are predicated upon a consideration of the bearing stress and sealability characteristics required to exist between said annular band of said second metallic member and said second straight bore portion of said first metallic member in order to effectuate a fire resistant metal-to-metal seal between said first metallic member and said second metallic member.

2. The fire resistant metal-to-metal sealing means as set forth in claim 1 wherein said annular band is formed integral with said second metallic member.

3. The fire resistant metal-to-metal sealing means as set forth in claim 2 wherein said second metallic member includes an extended neck portion and said annular band is formed on said extended neck portion.

4. The fire resistant metal-to-metal sealing means as set forth in claim 3 wherein a correlation exists between the height dimension of said annular band and the bearing stress characteristic of the seal established between said annular band of said second metallic member and said second straight bore portion of said first metallic member.

5. The fire resistant metal-to-metal sealing means as set forth in claim 4 wherein a correlation exists between the width dimension of said annular band and the sealability characteristic of the seal established between said annular band of said second metallic member and said second straight bore portion of said first metallic member.

6. The fire resistant metal-to-metal sealing means as set forth in claim 5 wherein said first metallic member comprises a tubing head.

7. The fire resistant metal-to-metal sealing means as set forth in claim 6 wherein said second metallic member comprises a casing hanger.

8. The fire resistant metal-to-metal sealing means as set forth in claim 5 wherein said first metallic member comprises a tubing bonnet.

9. The fire resistant metal-to-metal sealing means as set forth in claim 8 wherein said second metallic member comprises a tension hanger.

10. In a wellhead the improvement comprising at least one fire resistant metal-to-metal sealing means for effectuating the establishment of a fire resistant seal between a first pair of mating metallic members comprising:

a. a first member having a longitudinal bore and an inner circumferential surface defined by said longitudinal bore, said inner circumferential surface including a first tapered portion and a second straight bore portion; and b. a second metallic member of tubular configuration having an outer circumferential surface, said second metallic member being at least partially inserted into said longitudinal bore of said first metallic member such as to be coaxially received therewithin with said inner circumferential surface of said first metallic member surrounding said outer circumferential surface of said second metallic member, said second metallic member including an annular band formed integral therewith on said outer circumferential surface thereof adjacent one end of said second metallic member, said annular band engaging said inner circumferential surface of said first metallic member as said second metallic member is inserted into said longitudinal bore of said first metallic member such that as said annular band traverses said first tapered portion said annular band is caused to become preloaded and upon entering said second straight bore portion said annular band effects a seal therewith while remaining preloaded, said annular band having a height and a width embodying predetermined dimensions that are predicated upon a consideration of the bearing stress and sealability chracteristics required to exist between said annular band of said second metallic member and said second straight bore portion of said first metallic member in order to effectuate a fire resistant metal-to-metal seal between said first metallic member and said second metallic member.

11. In a wellhead as set forth in claim 10 the improvement comprising a second fire resistant metal-to-metal sealing means for effectuating the establishment of a fire resistant seal between a second pair of mating metallic members comprising:

a. a third metallic member having a longitudinal bore and an inner circumferential surface defined by said longitudinal bore, said inner circumferential surface including a first tapered portion and a second straight bore portion; and b. a fourth metallic member of tubular configuration having an outer circumferential surface, said fourth metallic member being at least partially inserted into said longitudinal bore of said third metallic member such as to be coaxially received therewithin with said inner circumferential surface of said third metallic member surrounding said outer circumferential surface of said fourth metallic member, said fourth metallic member including an annular band formed integral therewith on said outer circumferential surface thereof adjacent one end of said fourth metallic member, said annular band engaging said inner circumferential surface of said third metallic member as said fourth metallic member is inserted into said longitudinal bore of said third metallic member such that as said annular band traverses said first tapered portion said annular band is caused to become preloaded and upon entering said second straight bore portion said annular band effects a seal therewith while remaining preloaded, said annular band having a height and a width embodying predetermined dimensions that are predicated on a consideration of the bearing stress and sealability characteristics required to exist between said annular band of said fourth metallic member and said second straight bore portion of said third metallic member in order to effectuate a fire resistant metal-to-metal seal between said third metallic member and said fourth metallic member.

12. In a wellhead the improvement of first and second fire resistant metal-to-metal sealing means as set forth in claim 11 wherein said second metallic member and said fourth metallic member each include an extended neck portion having formed therein said annular band.

13. In a wellhead the improvement of first and second fire resistant metal-to-metal sealing means as set forth in claim 12 wherein a correlation exists between the height dimension of said annular band of said second metallic member and the bearing stress characteristic of the seal established between said annular band of said second metallic member and said second straight bore portion of said first metallic member, and a correlation exists between the width dimension of said annular band of said second metallic member and the sealability characteristic of the seal established between said annular band of said second metallic member and said second straight bore portion of said first metallic member.

14. In a wellhead the improvement of first and second fire resistant metal-to-metal sealing means as set forth in claim 13 wherein a correlation exists between the height dimension of said annular band of said fourth metallic member and the bearing stress characteristic of the seal established between said annular band of said fourth metallic member and said second straight bore portion of said third metallic member, and a correlation exists between the width dimension of said annular band of said fourth metallic member and the sealability characteristic of the seal established between said annular band of said fourth metallic member and said second straight bore portion of said third metallic member.

15. In a wellhead the improvemment of first and second fire resistant metal-to-metal sealing means as set forth in claim 14 wherein said first metallic member comprises a tubing head and said second metallic member comprises a casing hanger.

16. In a wellhead the improvement of first and second fire resistant metal-to-metal sealing means as set forth in claim 15 wherein said third metallic member comprises a tubing bonnet and said fourth metallic member comprises a tension hanger.

* * * * *